US008337011B2

(12) United States Patent
Seguchi et al.

(10) Patent No.: US 8,337,011 B2
(45) Date of Patent: Dec. 25, 2012

(54) INKJET RECORDING SHEET

(75) Inventors: Kenichi Seguchi, Okaya (JP); Kazuhiko Yamamoto, Chikuhoku-Mura (JP); Ichiro Miyamoto, Hirakata (JP); Masayuki Matsubara, Hirakata (JP); Masayoshi Iwasaki, Hirakata (JP); Hideyuki Uemura, Hirakata (JP)

(73) Assignees: Seiko Epson Corporation, Tokyo (JP); Union Chemicar Co., Ltd, Hirakata (JP)

( * ) Notice: Subject to any disclaimer, the term of this patent is extended or adjusted under 35 U.S.C. 154(b) by 221 days.

(21) Appl. No.: 12/820,278

(22) Filed: Jun. 22, 2010

(65) Prior Publication Data

US 2010/0321454 A1 Dec. 23, 2010

(30) Foreign Application Priority Data

Jun. 23, 2009 (JP) ..... 2009-148478

(51) Int. Cl.
*B41J 2/01* (2006.01)

(52) U.S. Cl. ..... 347/105; 347/101

(58) Field of Classification Search ..... 428/32.1
See application file for complete search history.

(56) References Cited

U.S. PATENT DOCUMENTS

| | | | | |
|---|---|---|---|---|
| 6,177,197 | B1 * | 1/2001 | Imashiro et al. | 428/32.36 |
| 7,226,160 | B2 * | 6/2007 | Tanaka et al. | 347/105 |
| 2001/0004487 | A1 * | 6/2001 | Kaneko et al. | 428/195 |
| 2005/0110855 | A1 * | 5/2005 | Taniuchi et al. | 347/103 |
| 2007/0146462 | A1 * | 6/2007 | Taniuchi et al. | 347/103 |
| 2009/0130309 | A1 * | 5/2009 | Kawakami et al. | 427/261 |

FOREIGN PATENT DOCUMENTS

| | | | |
|---|---|---|---|
| JP | 08310110 | A * | 11/1996 |
| JP | 2005-074880 | A | 3/2005 |
| JP | 2006-088341 | A | 4/2006 |
| JP | 2009-248356 | A | 10/2006 |
| KR | 2002067208 | A * | 8/2002 |

* cited by examiner

*Primary Examiner* — Stephen Meier

*Assistant Examiner* — Leonard S Liang

(74) *Attorney, Agent, or Firm* — Nutter McClennen & Fish LLP; John J. Penny, Jr.; Michael P. Visconti, III

(57) ABSTRACT

An inkjet recording sheet for forming an image using aqueous pigment ink that includes a substrate and an ink-receiving layer formed on the substrate. The ink-receiving layer is obtained by applying, on the substrate, a coating composition containing: a cationic acrylic silicone emulsion-based resin having a hydrolyzable silyl group as a crosslinking component; a cationic polyether-based urethane resin; and a carbodiimide group-containing resin, followed by curing the applied coating composition. In the coating composition, the content of the cationic acrylic silicone emulsion-based resin is 2 to 7% by mass, the content of the cationic polyether-based urethane resin is 88 to 94% by mass, and the content of the carbodiimide group-containing resin is 2 to 6% by mass in terms of solid matter.

4 Claims, No Drawings

INKJET RECORDING SHEET

TECHNICAL FIELD

The present invention relates to an inkjet recording sheet suitable for image recording with aqueous pigment ink. More specifically, it relates to an inkjet recording sheet having, on a substrate, an ink-receiving layer which is excellent in transparency and absorbing ability and prevents adhesion of the sheets themselves.

BACKGROUND ART

An inkjet recording method is a method wherein fine droplets of ink are ejected by various working principles and deposited on a recording medium such as paper or film to perform image recording. The inkjet recording method is widely utilized in terminal printers, facsimiles, plotters, sheet printing, and the like for the reasons of low noise, easiness of multicolor recording of full color images and the like, possibility of performing high-speed recording, lower recording cost than that in other printing devices, and so forth.

With regard to the image formed by the inkjet recording method, by increasing its image resolution and extending its color reproducible range, it is possible to obtain a recorded matter comparable to a multicolor print obtained by a plate-making method and a printed image obtained by a color photographic method, so that demand for images formed by the inkjet printing method has been rapidly increasing recently in design usage where high color-developing ability and color reproducibility are required, such as posters, displays, leaflets, package proofs, and the like.

With the extension of the above demand, since it becomes necessary to eject a large amount of ink for attaining the high color-developing ability and color reproducibility in the multicolor printing and the like, it is desired to develop an inkjet recording sheet having a large ink-receiving capacity corresponding to the ejected amount.

In general, two kinds of inkjet recording sheets are known, i.e., a void-type one and a polymer resin-type one. The void-type recording sheet has an ink-receiving layer where pores are formed of a filler such as silica, alumina, or calcium carbonate on a substrate, wherein a solvent of ink is absorbed in the pores through capillary attraction, and thereby only a color material component as a color-developing component is fixed on the surface. On the other hand, the polymer resin-type recording sheet has an ink-receiving layer formed of a polymer resin on a substrate, wherein the polymer resin itself absorbs a solvent while being swollen, and thereby only a color material component as a color-developing component is fixed on the surface. Dryness of the color materials can be enhanced by separation of the solvent from the color materials and absorption thereof by the receiving layer. Therefore, the higher the absorbing ability of the ink-receiving layer is, the more the dryness of the color materials is enhanced.

However, conventional inkjet recording sheets are suitable for dye ink but are not necessarily suitable for pigment ink. The reason is considered to be that pigment particles contained in pigment ink are generally very large as compared with dye, and thus it is required to develop an inkjet recording sheet suitable for recording with pigment ink.

On the other hand, in the design usage, a high transparency is required for the ink-receiving layer on which an image is to be recorded. In general, the void-type ink-receiving layer formed of a filler such as silica, alumina, or calcium carbonate has a low transparency and hence the polymer resin-type ink-receiving layer is preferable from the viewpoint of transparency.

Heretofore, as such a highly transparent polymer resin-type ink-receiving layer-forming material, polyvinyl alcohol, polyvinylpyrrolidone, starch, and water soluble cellulose derivatives have been proposed. However, in the method, particularly, the absorbing ability of aqueous pigment ink is poor. Resulting from the fact, when an ejected amount of ink is increased for high color-developing ability and color reproducibility, there is a problem that aggregation (phenomenon of forming a lump of ink on the surface) and spreading of pigment ink occur at the time of ink drying or the image is cracked due to excessive swelling of the receiving layer during drying. On the other hand, when the ejected amount of ink is too small, the color-developing ability is not attained and also the color reproducibility is poor. These problems caused by the absorbing ability are remarkably observed particularly under a low-temperature/high-humidity environment. Moreover, when the absorbing ability is poor, the drying property of the pigment to be fixed on the surface is also poor.

In this connection, Patent Document 1 proposes a recording sheet having an image-receiving layer (ink-receiving layer) comprising a cationic acrylic silicone emulsion-based resin and a cationic urethane-based resin, as an inkjet recording sheet for aqueous pigment ink usage. In Patent Document 1, resulting from such a constitution, it is said that there is obtained an inkjet recording sheet which is excellent in transparency or glossiness and also excellent in absorbing ability, drying property, and color-developing ability of ink.

Moreover, Patent Document 2 proposes, as an inkjet recording sheet for aqueous pigment ink usage, a recording sheet: having an image-receiving layer comprising two kinds of resins, i.e., an aqueous urethane resin and an aqueous acrylic resin; and containing a water soluble urethane polymer having an oxazoline group and an acrylic water soluble self-emulsifying epoxy curing agent as crosslinking agents. In Patent Document 2, resulting from such a constitution, it is said that there is obtained an inkjet recording sheet which is excellent in transparency or glossiness, also excellent in absorbing ability, drying property, and color-developing ability of ink, and satisfactory in water resistance property.

On the other hand, there is required an inkjet recording sheet having a further high quality in addition to transparency and absorbing ability. As one of the required characteristic properties, there is prevention of excessive adhesion (blocking) of the sheets themselves which occurs at the time when a plurality of the inkjet recording sheets are superposed. Generally, in order to prevent the adhesion of the inkjet recording sheets themselves, it is conducted to form unevenness on the sheet surface by adding fine particles such as silica particles into the ink-receiving layer. However, there are problems that the absorbing ability decreases by the influence of addition of the fine particles which do not contribute to the absorption of ink and also the transparency decreases by the influence of light scattering induced by fine particles.

[Patent Document 1] JP-A-2006-88341

[Patent Document 2] JP-A-2005-74880

SUMMARY OF THE INVENTION

An object of the invention is to provide a high-quality inkjet recording sheet having an ink-receiving layer, which satisfies all of transparency, absorbing ability, and adhesion-preventing ability.

Other objects and effects of the invention will become apparent form the following description.

As a result of extensive studies, the present inventors have found that the above problems can be solved by an ink-receiving layer obtained by crosslinking and curing a coating composition containing: a cationic acrylic silicone emulsion-based resin having a hydrolyzable silyl group as a crosslinking component; a cationic polyether-based urethane resin; and a carbodiimide group-containing resin in a particular ratio. Namely, the invention is as follows.

[1] An inkjet recording sheet for forming an image using aqueous pigment ink comprising:

a substrate; and an ink-receiving layer formed on the substrate, wherein the ink-receiving layer is obtained by applying, on the substrate, a coating composition containing: a cationic acrylic silicone emulsion-based resin having a hydrolyzable silyl group as a crosslinking component; a cationic polyether-based urethane resin; and a carbodiimide group-containing resin, followed by curing the applied coating composition, and wherein, in the coating composition, the content of the cationic acrylic silicone emulsion-based resin is 2 to 7% by mass, the content of the cationic polyether-based urethane resin is 88 to 94% by mass, and the content of the carbodiimide group-containing resin is 2 to 6% by mass in terms of solid matter.

[2] The inkjet recording sheet according to [1], wherein the ink-receiving layer contains silica particles.

[3] The inkjet recording sheet according to [2], wherein the silica particles has an average particle diameter of 5 to 16 μm.

[4] The inkjet recording sheet according to any one of [1] to [3], wherein the substrate is transparent.

[5] The inkjet recording sheet according to any one of [1] to [4], wherein the carbodiimide group-containing resin is a polycarbodiimide resin which contains carbodiimide group with a hydrophilic segment.

The ink-receiving layer of the inkjet recording sheet of the invention is suitable for image recording with aqueous pigment ink and has high transparency and absorbing ability. Therefore, even when the ejected amount of ink is increased, it is possible to record a high-quality image excellent in color-developing ability and color reproducibility without forming aggregation of pigment ink and cracks on the image layer. Also, such an ink-receiving layer has an adhesion-preventing effect of the sheets themselves.

MODE FOR CARRYING OUT THE INVENTION

The following will describe the inkjet recording sheet of the invention in detail.

The inkjet recording sheet of the invention has an ink-receiving layer obtained by applying a coating composition containing a cationic acrylic silicone emulsion-based resin, a cationic polyether-based urethane resin, and a carbodiimide group-containing resin on a substrate and crosslinking and curing the composition.

The cationic acrylic silicone emulsion-based resin for use in the invention is preferably one-component room temperature curable type one and has a hydrolyzable silyl group as a crosslinking component. The hydrolyzable silyl group is, for example, an alkoxysilyl group and is not particularly limited so far as it forms a silanol (Si—OH) through hydrolysis.

The cationic acrylic silicone emulsion-based resin in the invention is obtained by using an acrylic monomer having a hydrolyzable silyl group. Examples of the acrylic monomer having a hydrolyzable silyl group include 2-acryloxy(or methacryloxy)ethyltrimethoxysilane, 2-acryloxy(or methacryloxy)ethyltriethoxysilane, 3-acryloxy(or methacryloxy)propyltrimethoxysilane, 3-acryloxy(or methacryloxy)propylmethyldimethoxysilane, 3-acryloxy(or methacryloxy)propyltris(2-methoxyethoxy)silane, and the like. The cationic acrylic emulsion in the invention can be prepared, according to a known emulsion polymerization method, by adding an acrylic monomer and further a cationic reactive surfactant into an aqueous solvent to emulsify them, subsequently adding a radical polymerization initiator, and polymerizing the monomer with stirring under heating.

The cationic acrylic silicone emulsion-based resin is, for example, available as product names of Aquabrit 922, 903, 908 (manufactured by Daicel Chemical Industries, Ltd.) and the like.

With regard to the cationic polyether-based urethane resin for use in the invention, the polyol component and the polyisocyanate component as constituting monomer components and the polymerization method are not particularly limited so far as the resin has water solubility or water dispersibility and has a cationic functional group (e.g., a primary to tertiary amino group, quaternary ammonium salt, or the like). For example, the cationic polyether-based urethane resin can be obtained by polymerizing an aliphatic, alicyclic, or aromatic diisocyanate such as hexamethylene diisocyanate (HDI), dicyclohexylmethane diisocyanate (HMDI), or isophorone diisocyanate (IPDI) with a polyol obtained by introducing an amino group into the chain of a polyester polyol, a polyether polyol, polycarbonate polyol, or the like, according to a known method, and partly converting the amine into a quaternary amine with alkyl sulfate or the like. The substituent on the nitrogen in the cationic functional group includes a hydrogen atom, an alkyl group, an aryl group, an alkenyl group, an alkynyl group, a hydroxyalkyl group, and the like but is not limited thereto.

The cationic polyether-based urethane resin is, for example, available as product names of Parasurf UP-36 (manufactured by Ohara Paragium Chemical Co., Ltd.), Pascol E-77 (manufactured by Meisei Chemical Works, Ltd.), Supperflex 600 (manufactured by Dai-ichi Kogyo Seiyaku Co., Ltd., and having a solid content of 25%), and the like.

The carbodiimide group-containing resin for use in the invention is a resin having two or more carbodiimido groups in one molecule and is not particularly limited so far as it is a polycarbodiimide having water solubility or water dispersibility. Such a carbodiimide group-containing resin includes one having a hydrophilic group at the terminal end and can be, for example, produced by subjecting an organic diisocyanate compound to a condensation reaction involving decarboxylation to form an isocyanate-terminated polycarbodiimide and subsequently adding a hydrophilic segment having a functional group reactive with an isocyanate group.

The carbodiimide group-containing resin is, for example, available as product names of Carbodilite E02, E04, V02, V04 (manufactured by Nisshinbo Holdings Inc.), NK Assist CI (manufactured by Nicca Chemical Co., Ltd.), and the like.

The coating composition constituting the ink-receiving layer in the invention comprises the above components, and contains 2 to 7% by mass of the cationic acrylic silicone emulsion-based resin, 88 to 94% by mass of the cationic polyether-based urethane resin, and 2 to 6% by mass of the carbodiimide group-containing resin, in terms of solid matter. By using such resin composition and ratio, it becomes possible to form an ink-receiving layer satisfying all of transparency, absorbing ability, and adhesion-preventing ability.

When the content of the cationic acrylic silicone emulsion-based resin is less than 2% by mass, the adhesion-preventing ability decreases, and on the other hand, when the content exceeds 7% by mass, the absorbing ability decreases. When the absorbing ability of ink is poor, there occurs aggregation (phenomenon of forming a lump of ink on the surface) of pigment ink at the time of ink drying or cracking of an image owing to excessive swelling of the receiving layer on the way of drying. Hence, a good image is not obtained. In the coating composition, the content of the cationic acrylic silicone emulsion-based resin is preferably 3 to 6% by mass.

Moreover, when the content of the cationic polyether-based urethane resin is less than 88% by mass, the absorbing ability decreases and, on the other hand, when the content exceeds 94% by mass, the adhesion-preventing ability decreases. The content of the cationic polyether-based urethane resin is preferably 90 to 93% by mass.

Furthermore, when the content of the carbodiimide group-containing resin is less than 2% by mass, the adhesion-preventing ability decreases and, when the content exceeds 6% by mass, the absorbing ability decreases and also there is a concern of a decrease in transparency of the ink-receiving layer. The content of the carbodiimide group-containing resin is preferably 3 to 5% by mass.

In the invention, film-forming ability and water resistance property of the ink-receiving layer is secured by crosslinking the carbodiimide group-containing resin with the hydrolyzable silyl group of the cationic acrylic silicone emulsion-based resin. Since only the presence of the cationic acrylic silicone emulsion-based resin and the cationic polyether-based urethane resin is insufficient for satisfying both of the water resistance property and the absorbing ability, it becomes possible to satisfy both of the water resistance property and the absorbing ability by forming a crosslinked film with the carbodiimide group-containing resin and the cationic acrylic silicone emulsion-based resin. When the amount of the carbodiimide group-containing resin is less than 2% by mass, the film formation with the cationic acrylic silicone emulsion-based resin becomes insufficient and hence the water resistance property deteriorates. On the other hand, when the amount of the carbodiimide group-containing resin exceeds 6% by mass, the amount of the cationic acrylic silicone emulsion-based resin decreases and thus the water resistance property deteriorates.

The above-described coating composition in the invention may contain fine particles of alumina, calcium carbonate, silica, or the like, in order to further enhance the adhesion-preventing effect. In the invention, high absorbing ability and adhesion-preventing effect of the ink-receiving layer are exhibited by resin component species and ratio thereof but the adhesion of the sheets themselves can be further prevented by adding the fine particles to form unevenness on the surface of the ink-receiving layer. In the invention, the average particle diameter of the fine particles is preferably 5 to 16 μm, more preferably 10 to 14 μm. The larger average particle diameter of the fine particles to be added can enhance the adhesion-preventing ability with a smaller amount of the particles to be added. However, since these fine particles do not contribute to absorption, the addition of a larger amount thereof inhibits the ink absorbing ability and also results in disappearance of smooth feeling of the substrate owing to the unevenness. On the other hand, when the average particle diameter of the fine particles to be added is small, the effect of adhesion prevention is not obtained and, when the fine particles are added until the adhesion-preventing effect is obtained, the transparency of the ink-receiving layer decreases. The average particle diameter of the fine particles can be measured by observation of the surface with an optical microscope or by means of a thick system particle diameter analyzer (manufactured by Otsuka Electronics Co., Ltd.) or the like. The fine particles are preferably contained in the coating composition in an amount of 0.25% by mass or less.

The inkjet recording sheet of the invention is formed by applying the above-described coating composition on a substrate with a bar coater or the like, followed by curing.

The substrate includes synthetic resin films such as polyesters, polyolefins, and polyvinyl chloride and papers such as synthetic papers. Also, the substrate can be subjected to a surface treatment such as a corona discharge treatment to improve coating ability of the ink-receiving layer. In the invention, the substrate is preferably transparent.

The thickness of the substrate is preferably in the range of 25 to 400 μm and, in consideration of loading ability on a printer and handling ability, it is preferably 50 to 300 μm. When the thickness of the substrate is less than 25 μm, handling ability and loading ability on a printer are poor, and also the recording medium loaded on the printer is sometimes not normally transferred, for example, wrinkling occurs when it is fed. Also, when the thickness of the substrate exceeds 400 μm, the loading on the printer may become difficult or normal paper feeding may be not attained. However, the thickness of the substrate is not limited to the above thickness.

From the viewpoint of the absorbing ability, the thickness of the ink-receiving layer after cured is preferably 5 to 50 μm, further preferably 10 to 30 μm but is not limited thereto.

The curing temperature for crosslinking and curing the coating composition is preferably 80 to 130° C., more preferably 100 to 125° C. The curing time may be about 1 to 5 minutes although it depends on the curing temperature.

Moreover, at the application of the coating composition on the substrate, applicability may be improved by preparing an aqueous solution containing the coating composition.

EXAMPLES

The present invention will be illustrated in greater detail with reference to the following Examples, but the invention should not be construed as being limited thereto.

(Preparation of InkJet Recording Sheet)

First, a cationic urethane resin, a cationic acrylic silicone emulsion-based resin, a carbodiimide group-containing resin, and silica particles were sequentially charged into ion-exchange water so as to be the contents in terms of solid matter described in the following Table 1, and a stirring treatment was performed to prepare a coating liquid.

The obtained coating liquid was applied on one surface of a polyester film manufactured by Teijin DuPont Films Japan Limited as a substrate so that a cured coating film has a thickness of 20 μm and dried and cured to thereby obtain an inkjet recording sheet having an ink-receiving layer on the substrate. Table 1 shows respective composition ratios (% by mass) of the coating compositions constituting the receiving layers of Examples 1 to 24 and Comparative Examples 1 to 15.

The components contained in each coating liquid in Table 1 are as follows.

A: a cationic polyether-based urethane resin; "Parasurf UP-36" (manufactured by Ohara Paragium Chemical Co., Ltd.).

B: a cationic polyether-based urethane resin; another type of Parasurf series manufactured by Ohara Paragium Chemical Co., Ltd. was used.

H: a cationic polycarbonate-based urethane resin; "Pascol JK-4A" (manufactured by Meisel Chemical Works, Ltd.).

C: a cationic acrylic silicone emulsion-based resin; "Aquabrit 922" (manufactured by Daicel Chemical Industries, Ltd.).

D: a carbodiimide group-containing resin; NK Assist CI (manufactured by Nicca Chemical Co., Ltd.).

E: a carbodiimide group-containing resin; Carbodilite SV-02 (manufactured by Nisshinbo Holdings Inc.).

F: silica particles (average particle diameter: 5 μm, specific surface area 700 $m^2/g$); "Sylysia 740" (manufactured by Fuji Silysia Chemical Ltd.).

G: silica particles (average particle diameter: 11 μm, specific surface area 700 $m^2/g$); "Sylysia 780" (manufactured by Fuji Silysia Chemical Ltd.).

<Evaluation of Inkjet Recording Sheet>

(1) Evaluation of Adhesion-preventing Ability

The adhesion-preventing ability of the inkjet recording sheets of Examples 1 to 24 and Comparative Examples 1 to 15 formed in the above was evaluated. The evaluation of adhesion-preventing ability was carried out by visually judging the adhesion state at the time when 20 sheets of the respective inkjet recording sheet were superposed and allowed to stand under an environment of 23° C. and 50% RH for 1 day. The judging criteria are as follows.

0: No evidence of adhesion was observed.

1: Adhesion was observed at a part of faces.

2: Adhesion was observed at most faces.

(2) Evaluation of Transparency

The transparency of the inkjet recording sheets of Examples 1 to 24 and Comparative Examples 1 to 15 formed in the above was evaluated. The evaluation of transparency was carried out by measuring parallel line transparency at the time when irradiation was applied from the ink-receiving layer side under an environment of 23° C. and 50% RH using a haze meter "NDH 5000" manufactured by Nippon Denshoku Industries Co., Ltd. (a test method in accordance with JIS K 7361). The judging criteria are as follows.

0: Parallel line transparency was more than 84%

1: Parallel line transparency was 80 to 84%

2: Parallel line transparency was less than 80%

(3) Evaluation of Absorbing Ability (Presence of Aggregation of Pigment Ink and Crack Occurrence)

Solid printing with cyan ink, magenta ink, yellow ink, black ink, and mixed colors thereof, i.e., red (magenta+yellow), green (cyan+yellow), and blue (magenta+cyan) was performed on the ink-receiving layer side of each of the inkjet recording sheets of Examples 1 to 24 and Comparative Examples 1 to 15 formed in the above using a printer "PX-6500" manufactured by Seiko Epson Corporation. A solid pattern having a printing resolution of 1440 dpi×720 dpi and a dot number per unit square inch of 1,036,800 (DUTY 100%) was printed and the obtained printed matter was allowed to stand under conditions of 23° C. and 50% RH for 24 hours, followed by evaluation of the absorbing ability. The evaluation of the absorbing ability was performed by confirming the state of the print surface after standing with regard to at least either of aggregation and cracking of pigment ink. The judging criteria are as follows.

0: There was no problem.

1: Minute cracks occurred.

2: Cracks and aggregation occurred (slight deterioration).

3: Crack and aggregation were remarkably deteriorated.

Table 1 shows individual evaluation results of the above (1) to (3) and overall evaluation thereof.

TABLE 1

| | | Composition of coating composition for ink-receiving layer formation (% by mass (in terms of solid matter)) | | | | | | | | Evaluation results | | | |
|---|---|---|---|---|---|---|---|---|---|---|---|---|---|
| | | Cationic urethane resin | | | Cationic acrylic silicone emulsion resin | Carbodiimide group-containing resin | | Silica particles | | Adhesion-preventing ability | Transparency | Absorbing ability (aggregation-cracking of pigment ink | Overall evaluation |
| | | A | B | H | C | D | E | F | G | | | | |
| Comparative Example 1 | PTC0 | 95.95 | | | 0.0 | 4.0 | | 0.05 | | 2 | 0 | 2 | 4 |
| Comparative Example 2 | PTC1 | 94.95 | | | 1.0 | 4.0 | | 0.05 | | 2 | 0 | 2 | 4 |
| Example 1 | PTC2 | 93.95 | | | 2.0 | 4.0 | | 0.05 | | 1 | 0 | 2 | 3 |
| Example 2 | PTC3 | 92.95 | | | 3.0 | 4.0 | | 0.05 | | 1 | 0 | 2 | 3 |
| Example 3 | PTC4 | 91.95 | | | 4.0 | 4.0 | | 0.05 | | 1 | 0 | 2 | 3 |
| Example 4 | PTC5 | 90.95 | | | 5.0 | 4.0 | | 0.05 | | 1 | 0 | 2 | 3 |
| Example 5 | PTC6 | 89.95 | | | 6.0 | 4.0 | | 0.05 | | 1 | 0 | 2 | 3 |
| Example 6 | PTC7 | 88.95 | | | 7.0 | 4.0 | | 0.05 | | 1 | 0 | 2 | 3 |
| Comparative Example 3 | PTC23 | 86.25 | | | 10.2 | 3.5 | | 0.05 | | 1 | 1 | 3 | 5 |
| Comparative Example 4 | PTC24 | 81.05 | | | 15.6 | 3.3 | | 0.05 | | 1 | 1 | 3 | 5 |
| Comparative Example 5 | PTC25 | 76.35 | | | 20.5 | 3.1 | | 0.05 | | 1 | 2 | 3 | 6 |
| Comparative Example 6 | PTC8-0 | 94.95 | | | 5.0 | 0.0 | | 0.05 | | 1 | 0 | 2 | 3 |
| Comparative Example 7 | PTC8 | 94.45 | | | 5.0 | 0.5 | | 0.05 | | 1 | 0 | 2 | 3 |
| Comparative Example 8 | PTC9 | 93.95 | | | 5.0 | 1.0 | | 0.05 | | 1 | 0 | 2 | 3 |
| Example 7 | PTC10 | 92.95 | | | 5.0 | 2.0 | | 0.05 | | 1 | 0 | 1 | 2 |
| Example 8 | PTC11 | 91.95 | | | 5.0 | 3.0 | | 0.05 | | 1 | 0 | 1 | 2 |
| Example 9 | PTC13 | 89.95 | | | 5.0 | 5.0 | | 0.05 | | 1 | 0 | 1 | 2 |
| Example 10 | PTC14 | 88.95 | | | 5.0 | 6.0 | | 0.05 | | 1 | 0 | 1 | 2 |

TABLE 1-continued

| | | Composition of coating composition for ink-receiving layer formation (% by mass (in terms of solid matter)) | | | | | | | | Evaluation results | | | |
|---|---|---|---|---|---|---|---|---|---|---|---|---|---|
| | | Cationic urethane resin | | | Cationic acrylic silicone emulsion resin | Carbodiimide group-containing resin | | Silica particles | | Adhesion-preventing ability | Transparency | Absorbing ability (aggregation-cracking of pigment ink | Overall evaluation |
| | | A | B | H | C | D | E | F | G | | | | |
| Comparative Example 9 | PTC26 | 85.15 | | | 4.2 | 10.6 | | 0.05 | | 1 | 1 | 3 | 5 |
| Comparative Example 10 | PTC27 | 80.65 | | | 4.2 | 15.1 | | 0.05 | | 1 | 1 | 3 | 5 |
| Comparative Example 11 | PTC28 | 76.15 | | | 3.8 | 20.0 | | 0.05 | | 1 | 1 | 3 | 5 |
| Comparative Example 12 | PTC20 | | | 91.5 | 4.7 | 3.75 | | 0.05 | | 2 | 0 | 3 | 5 |
| Example 11 | TC15 | | 91.32 | | 4.7 | 3.9 | | | 0.08 | 0 | 0 | 1 | 1 |
| Example 12 | TC16 | | 91.26 | | 4.7 | 3.9 | | 0.14 | | 0 | 0 | 2 | 2 |
| Example 13 | TC17 | | 89.92 | | 4.9 | 5.1 | | | 0.08 | 0 | 0 | 1 | 1 |
| Example 14 | TC18 | | 90.01 | | 4.7 | 5.15 | | 0.14 | | 0 | 0 | 2 | 2 |
| Example 15 | TC18-1 | | 90.51 | | 4.2 | 5.15 | | 0.14 | | 0 | 0 | 2 | 2 |
| Example 16 | TC18-2 | | 91.01 | | 3.7 | 5.15 | | 0.14 | | 0 | 0 | 2 | 2 |
| Example 17 | TC18-3 | | 91.51 | | 3.2 | 5.15 | | 0.14 | | 0 | 0 | 2 | 2 |
| Example 18 | TC18-4 | | 92.01 | | 2.7 | 5.15 | | 0.14 | | 0 | 0 | 2 | 2 |
| Comparative Example 13 | TC19-4 | | 94.12 | | 4.8 | | 1.0 | | 0.08 | 0 | 0 | 2 | 2 |
| Example 19 | TC19-3 | | 93.12 | | 4.8 | | 2.0 | | 0.08 | 0 | 0 | 1 | 1 |
| Example 20 | TC19-2 | | 92.12 | | 4.8 | | 3.0 | | 0.08 | 0 | 0 | 1 | 1 |
| Example 21 | TC19 | | 91.32 | | 4.8 | | 3.8 | | 0.08 | 0 | 0 | 0 | 0 |
| Example 22 | TC19-1 | | 90.02 | | 4.8 | | 5.1 | | 0.08 | 0 | 0 | 0 | 0 |
| Example 23 | TC19-5 | | 89.62 | | 4.8 | | 5.5 | | 0.08 | 0 | 0 | 0 | 0 |
| Example 24 | TC19-6 | | 89.12 | | 4.8 | | 6.0 | | 0.08 | 0 | 0 | 0 | 0 |
| Comparative Example 14 | TC19-7 | | 88.62 | | 4.8 | | 6.5 | | 0.08 | 0 | 0 | 2 | 2 |
| Comparative Example 15 | TC19-8 | | 88.12 | | 4.8 | | 7.0 | | 0.08 | 0 | 0 | 2 | 2 |

From the results of Examples 1 to 10 and Comparative Examples 1 to 12 as well as Examples 19 to 24 and Comparative Examples 13 to 15, it can be seen that the ink-receiving layer obtained by crosslinking and curing a coating composition containing 88 to 94% by mass of a cationic polyether-based urethane resin, 2 to 7% by mass of a cationic acrylic silicone emulsion-based resin having a hydrolyzable silyl group as a crosslinking component, and 2 to 6% by mass of a carbodiimide group-containing resin has high transparency and has high ink absorbing ability and adhesion-preventing ability even under low-temperature and high-humidity environment.

On the other hand, since the content of the carbodiimide group-containing resin is small in Comparative Examples 6 to 8 and Comparative Example 13, a crosslinked film with the cationic acrylic silicone emulsion-based resin is not satisfactorily formed and water resistance property was poor, so that the results were practically unsuitable.

When Example 11 is compared with Example 12, and Example 13 is compared with Example 14, it can be seen that both of the adhesion-preventing ability and the absorbing ability can be satisfied in a more highly advanced degree by containing silica particles having a large average particle diameter in a small amount.

While the invention has been described in detail and with reference to specific embodiments thereof, it will be apparent to one skilled in the art that various changes and modifications can be made therein without departing from the spirit and scope thereof.

The present application is based on Japanese Patent Application No. 2009-148478 filed on Jun. 23, 2009, and the entire contents are incorporated herein by reference.

What is claimed is:

1. An inkjet recording sheet for forming an image using aqueous pigment ink comprising:

a substrate; and an ink-receiving layer formed on the substrate, wherein the ink-receiving layer is obtained by applying, on the substrate, a coating composition containing: silica particles, a cationic acrylic silicone emulsion-based resin having a hydrolyzable silyl group as a crosslinking component; a cationic polyether-based urethane resin; and a carbodiimide group-containing resin, followed by curing the applied coating composition, and wherein, in the coating composition, the content of the silica particles is 0.25% by mass or less, the content of the cationic acrylic silicone emulsion-based resin is 2 to 7% by mass, the content of the cationic polyether-based urethane resin is 88 to 94% by mass, and the content of the carbodiimide group-containing resin is 2 to 6% by mass in terms of solid matter.

2. The inkjet recording sheet according to claim 1, wherein the silica particles have an average particle diameter of 5 to 16 μm.

3. The inkjet recording sheet according to claim 1, wherein the substrate is transparent.

4. The inkjet recording sheet according to claim 1, wherein the carbodiimide group-containing resin is a polycarbodiimide resin which contains carbodiimide group with a hydrophilic segment.

* * * * *